United States Patent [19]

Huang

[11] 4,156,974

[45] Jun. 5, 1979

[54] COMBINATION PLANT SEEDLING-BULK TOBACCO SUPPORT STRUCTURE

[76] Inventor: Barney K. Huang, 2008 Varnell Ave., Raleigh, N.C.

[21] Appl. No.: 889,746

[22] Filed: Mar. 24, 1978

Related U.S. Application Data

[63] Continuation-in-part of Ser. No. 698,462, Jun. 21, 1976, abandoned.

[51] Int. Cl.[2] ..... A24B 1/06; F26B 25/06

[52] U.S. Cl. ..... 34/236; 34/239; 432/162; 432/500; 414/26; 131/134; 220/22.4

[58] Field of Search ..... 432/160, 162, 500; 34/93, 236, 239, DIG. 12, 237, 219, 201, 225; 214/5.5; 131/134; 220/22.1, 22.4, 22.6

[56] References Cited

U.S. PATENT DOCUMENTS

| | | | |
|---|---|---|---|
| 2,330,976 | 10/1943 | Jones et al. | 220/22.4 |
| 3,088,603 | 5/1963 | Boyette | 214/5.5 |
| 3,659,899 | 5/1972 | Whitley | 214/5.5 |
| 3,855,451 | 12/1974 | Lee | 34/219 |
| 3,866,334 | 2/1975 | Huang | 34/93 |
| 3,932,946 | 1/1976 | Johnson | 432/500 |
| 3,935,648 | 2/1976 | Cox | 432/500 |
| 3,935,959 | 2/1976 | Long | 432/500 |
| 3,999,303 | 12/1976 | Martin et al. | 432/500 |

*Primary Examiner*—Henry C. Yuen
*Attorney, Agent, or Firm*—Mills & Coats

[57] ABSTRACT

The present invention relates to a material handling device that is adapted to have utility in both a greenhouse operation and a bulk tobacco curing and drying structure. More particularly, in use with a greenhouse, the material handling device of the present invention is adapted to support plant seedlings or pots of soil with seeds appropriately planted therein. The same material handling device of the present invention can also be utilized in a bulk tobacco curing and drying operation as a support and handling medium for bulk tobacco disposed within the curing and drying structure.

9 Claims, 14 Drawing Figures

FIG. 10
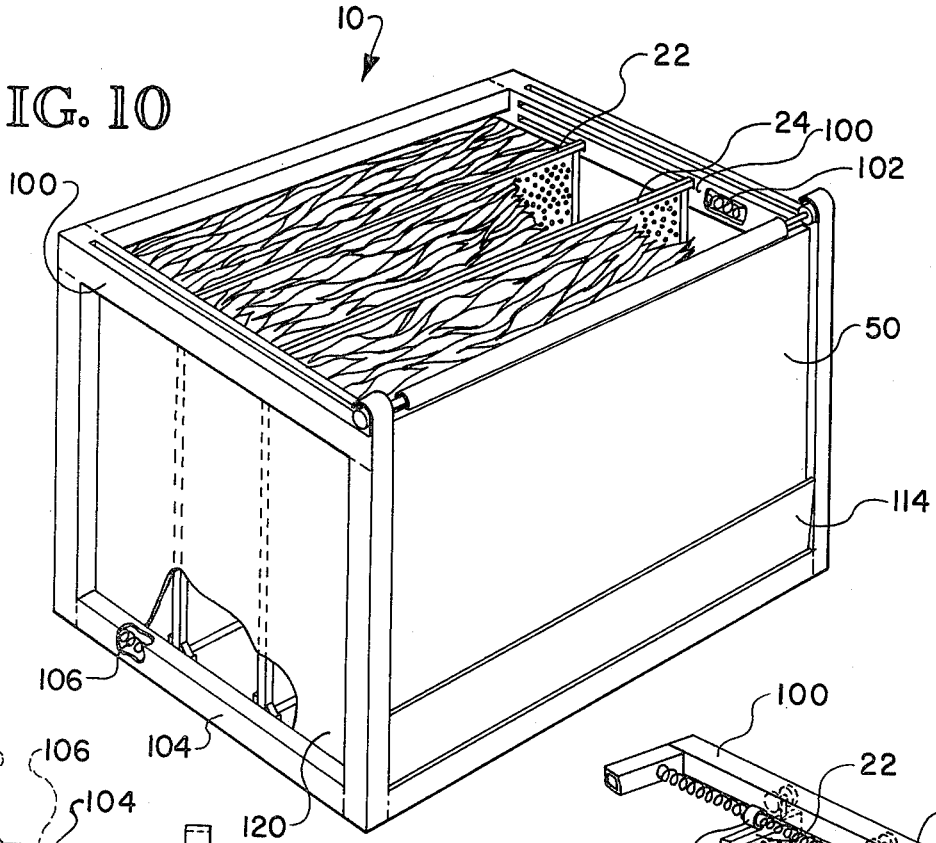
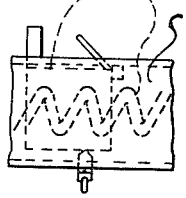
FIG. 12
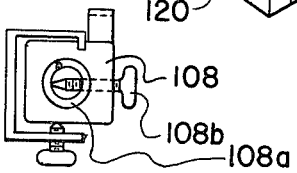
FIG. 13
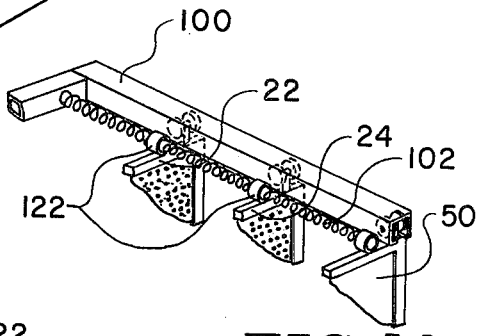
FIG. 14
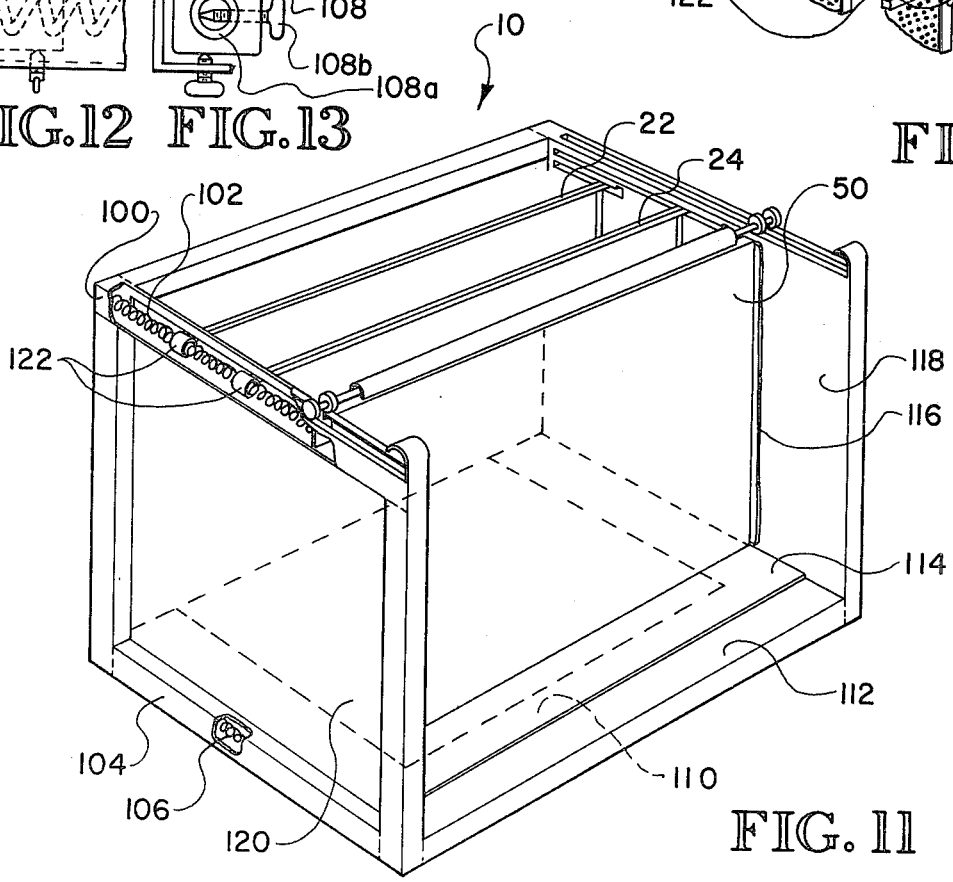
FIG. 11

COMBINATION PLANT SEEDLING-BULK TOBACCO SUPPORT STRUCTURE

This application is a coninuation-in-part application of U.S. patent application Ser. No. 698,462, filed June 21, 1976, now abandoned.

The present invention relates to material handling device and more particularly to a combination support structure in the form of a portable frame that is adapted to support plant seedlings when utilized in conjunction with a greenhouse operation, and to form a container-like bulk tobacco support structure for handling and supporting tobacco during a bulk tobacco curing and drying operation and to particularly support the tobacco within the structure to form a drying chamber during the curing and drying process.

BACKGROUND OF THE INVENTION

In U.S. Pat. No. 3,866,334, Dr. B. K. Huang disclosed what has become known as a greenhouse-bulk tobacco curing barn. Basically, as disclosed in this patent, the structure disclosed therein can be utilized as either a greenhouse or as a bulk tobacco curing and drying structure. While various plants and horticultural crops can be grown in the structure when used as a greenhouse, of particular significance to tobacco farmers is the fact that tobacco seedlings can also be grown therein, and after reaching a certain maturity, the tobacco seedlings can be transplanted in the field.

SUMMARY OF THE INVENTION

In an effort to make components of the greenhouse-bulk curing and drying structure as common as possible for both greenhouse and curing and drying operations, the present invention presents a new material handling device in the form of a portable support structure that is adapted for use in both greenhouse operations and bulk tobacco curing and drying operations. More particularly, the material handling device of the present invention is referred generally to as a combination support structure and functions in one mode to support plant seedlings or the like as a part of a greenhouse operation, and in another mode the same combination support structure is adapted to support a volume of bulk tobacco in a containerized fashion to form a drying chamber within the greenhouse structure. In either case, the combination support structure is designed with features that give the same portability, and accordingly the combination support structure of the present invention is particularly adapted to be transferred in and out of the greenhouse-bulk tobacco curing and drying structure.

It is, therefore, an object of the present invention to provide a material handling device in the form of a portable support structure that is adapted to be utilized in conjunction with a greenhouse-bulk curing and drying structure to either support and handle plant seedlings or the like when the structure is utilized as a greenhouse, or to support and handle a bulk volume of tobacco to form a drying chamber when the same structure is utilized as a bulk tobacco curing and drying structure.

Still a further object of the present invention is to provide a material handling device in accordance with the present invention that is easily and readily transferrable into and out of a curing and drying structure, as well as being easily movable within the structure so as to allow the same to be properly positioned therein for either greenhouse or curing and drying operations.

A more particular object of the present invention is to provide a material handling device in the form of a combination support portable structure that is provided with a plurality of screens or perforated members that have utility in both the greenhouse and curing and drying operations, and wherein said screens or perforated members are adapted to support plant seedlings or the like during greenhouse use and wherein the same screens or perforated members act to compress and divide layers of tobacco leaf material received within said combination support structure during the curing and drying operation.

Another object of the present invention resides in the provision of a material handling device for supporting a volume of bulk tobacco therein, wherein the necessity of leaf supporting tines is obviated by the provision of a plurality of screens wherein each screen is utilized to compress a layer of tobacco within the material handling device such that once the latter is filled the material handling device forms a container type structure and the tobacco leaf material supported therein is disposed in layers separated by said plurality of screens.

Other objects and advantages of the present invention will become apparent from a study of the following description and the accompanying drawings which are merely illustrative of the present invention.

BRIEF DESCRIPTION OF THE DRAWINGS

FIG. 10 is a perspective view of a modified embodiment of the support structure for curing tobacco.

FIG. 11 is also a perspective view similar to FIG. 10 with structural portions broken away to better illustrate the spring biasing of the screens.

FIGS. 12 and 13 are detail views illustrating a spring and the screen locking blocks associated therewith.

FIG. 14 is a fragmentary perspective view illustrating the relationship of a biasing spring, the screens, and the support structure.

DESCRIPTION OF PREFERRED EMBODIMENT

Figure 1:
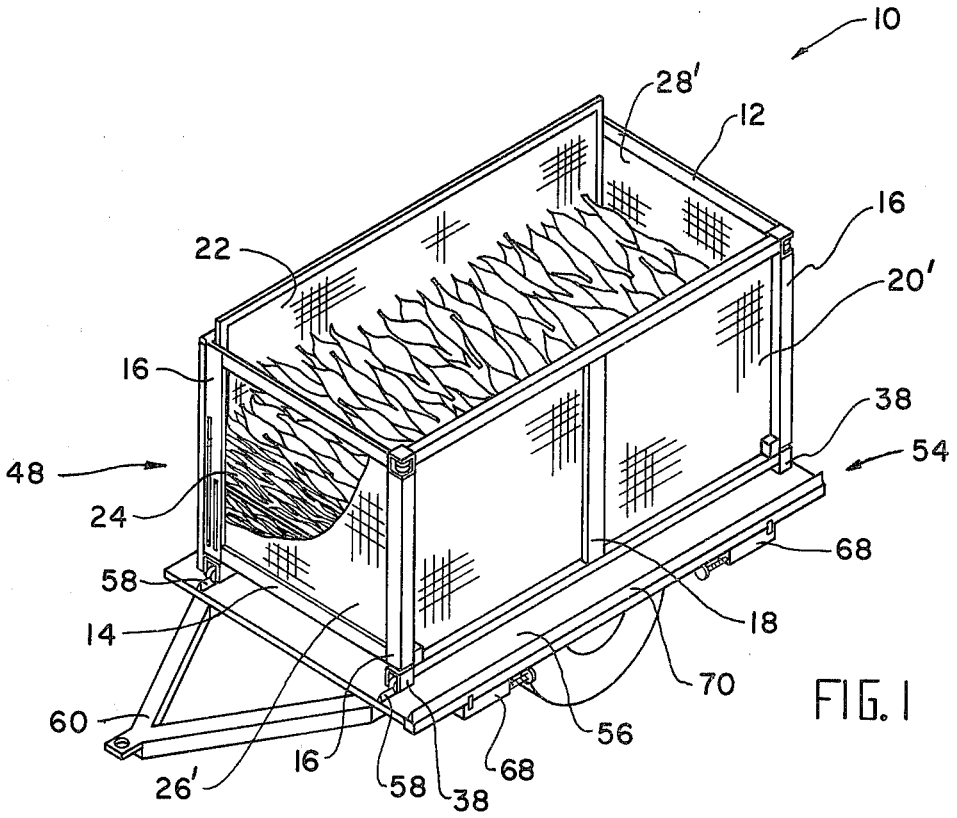
FIG. 1 is a perspective view of the material handling device of the present invention supported on a trailer with the same being adapted for supporting a volume of bulk tobacco and shown partially filled in a filling position.

With further reference to the drawings, the material handling device of the present invention is shown therein and indicated generally by the numeral 10 and referred to in this discussion as a combination support structure. First, with respect to FIG. 2 and the use of the combination support structure 10 in a greenhouse operation to support plant seedlings, it is seen that the same includes a portable frame structure that comprises top and bottom rectangular frames 12 and 14 respectively, the top and bottom frames 12 and 14 being supported by four corner posts each indicated by the numeral 16. This frame structure further includes an intermediate side post 18 disposed on each side thereof and extending between the top and lower frames 12 and 14.

As a plant seedling support structure, the combination support structure 10 of the present invention comprises a series of generally horizontally screens in vertical spaced apart relationship, these screens being referred to as a top screen 20, two intermediate screens 22 and 24, and a bottom screen assembly including bottom half screens 26 and 28 removably mounted in side-by-side relationship. It will be appreciated that although the preferred embodiment shown in FIG. 2 discloses four levels of screens, that the number of screens could vary according to design requirements and other design criteria.

Figure 2:
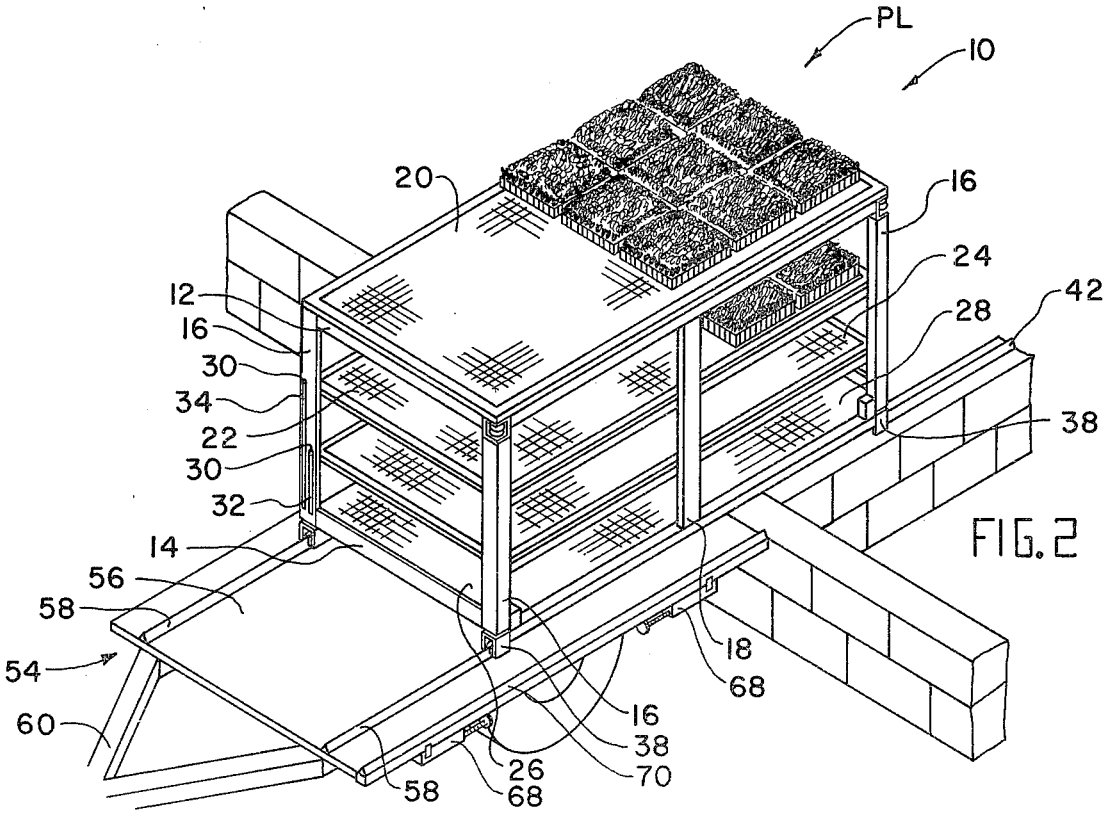
FIG. 2 is a perspective view of the material handling device of the present invention shown adapted for supporting plant seedlings and wherein the device as adapted is shown partially loaded with plant seedlings.
Figure 3:
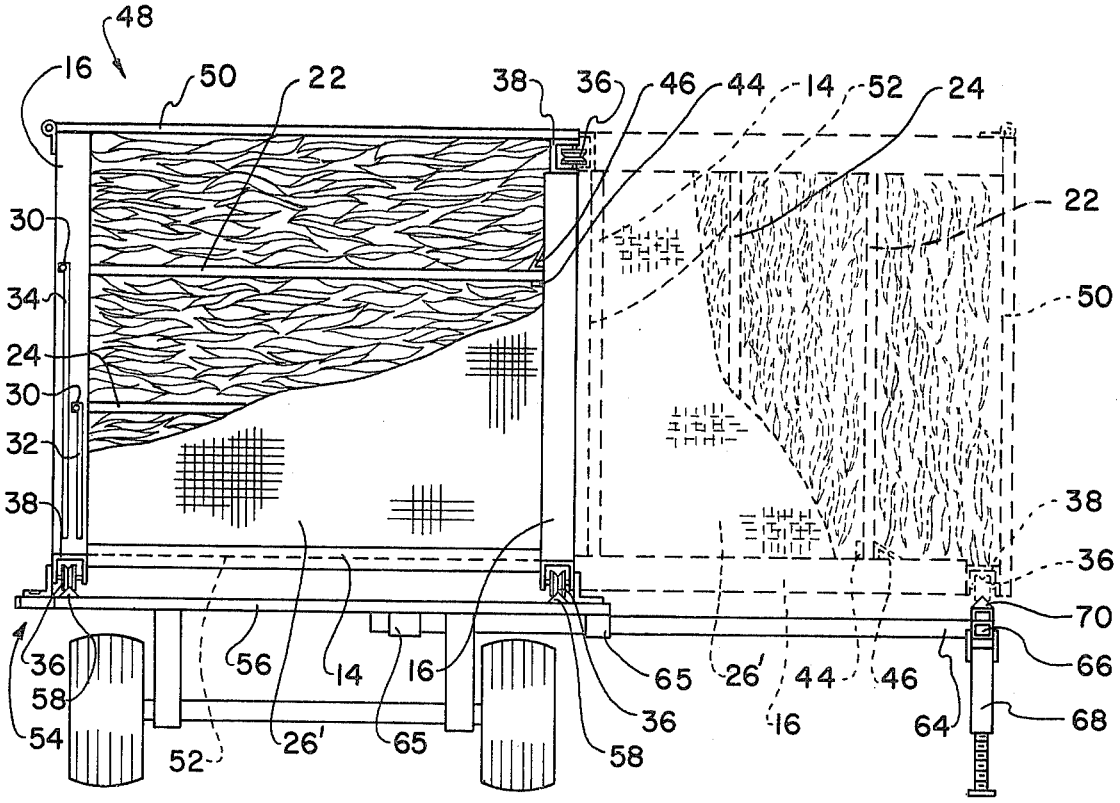
FIG. 3 is a front elevational view of the material handling device of the present invention as used in a tobacco curing and drying operation with the same being shown in the normal filling position in full lines, and rotated approximately 90 degrees to the curing and drying position shown in dotted lines.

In the preferred embodiment of FIG. 2, the intermediate screens 22 and 24 are each provided about one side thereof with a pair of pivot shafts 30 that extend outwardly from one side of the respective screens. The pivot shafts 30 of each screen 22 or 24 are confined within one of two generally vertical slots 32 and 34 formed in each of the corner posts 16 disposed on the left-hand side of the frame structure as viewed from the front thereof. Each slot 32 and 34 is provided with an upper off-set pivot support indention, as best seen in FIG. 3. About the right-hand side of the frame structure, there is provided means for supporting each of the screens in a generally horizontal plane. Although various forms of support means might be used, for the intermediate pivoting screens 22 and 24, there is provided tab support means 44 about the right side of the frame structure for receiving the side of the screen opposite the pivot shafts 30. Also, above each tab support means 44 there is shown a latching mechanism 46 such as a spring steel latch or some other suitable latching mechanism that would be sturdy and strong. This is particularly important when the combination support structure is utilized as a bulk tobacco container, as will be appreciated from subsequent portions of the disclosure.

In operation, the combination support structure as shown in the embodiment of FIG. 2 is adapted to support plant seedlings PL in a tray of the type shown in U.S. Pat. No. 3,712,252 (herein incorporated by reference) about all four screens or any portion thereof to give an air pruning effect. Also, the combination support structure 10 of the present invention is provided with rollers 36 disposed about the bottom side and right-hand side of the frame structure as viewed in FIG. 2. Each roller 36 is rotatively mounted within a housing 38 that forms a part of the combination support structure 10 and the frame structure thereof. Thus, it is appreciated that when used as a plant seedling support, the combination support structure becomes a portable frame and can be moved in and out of a greenhouse-bulk tobacco curing structure, indicated generally by the numeral 40 in FIG. 4, the structure being provided with spaced apart guide rails 42 with front aligning guides **42*a* that are adapted to support respective rollers 36**.

Figure 4:
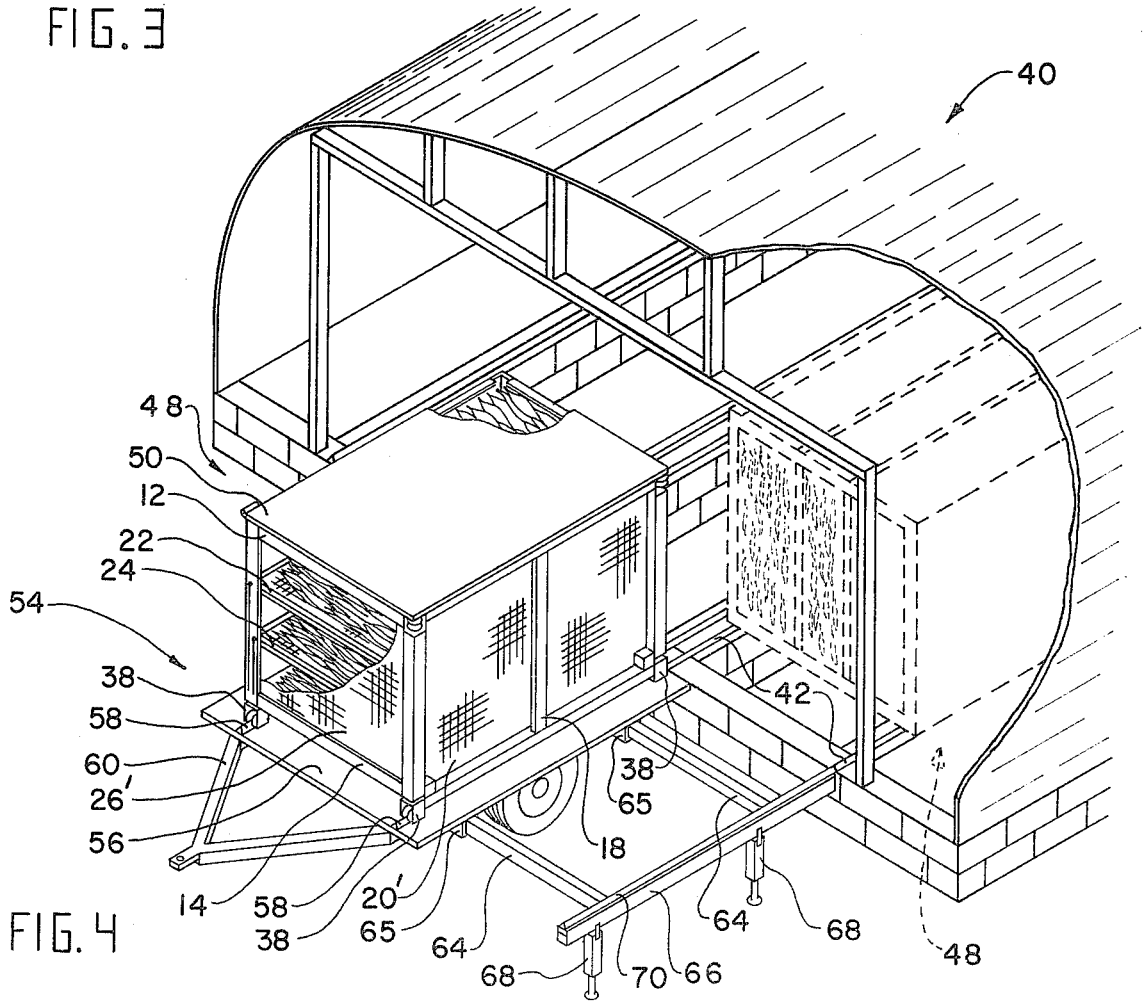
FIG. 4 is a fragmentary perspective view of the material handling device of the present invention adjacent a greenhouse-bulk tobacco curing and drying structure, the material handling device being adapted for supporting tobacco and for use in tobacco curing and drying operation.

Turning to a discussion of the preferred embodiments particularly illustrated in FIGS. 1, 3 and 4, it is seen that the combination support structure 10 can be slightly altered such that the same becomes a bulk tobacco container, indicated generally by the numeral 48 in these Figures. Basically, the top screen 20 of the plant seedling embodiment is removed and replaced by a pivotably mounted imperforated top member 50 (that preferably becomes a solar heat collector in use and forms a part of the drying chamber) that is swingably mounted from a normally open side position adjacent the left side of the frame structure to a top closed position that is illustrated in FIGS. 3 and 4. Bottom half screens 26 and 28 of the embodiment shown in FIG. 2 are removed therefrom and detachably mounted about the front and rear ends of the tobacco container embodiment and as utilized therein are indicated by 26' and 28'. The half screens 26 and 28 are replaced by a bottom imperforated member 52.

The removed top screen 20 can then be detachably mounted to the right side of the tobacco container embodiment and as located therein is indicated by 20'. Screen 20' becomes the bottom of the container when rotated.

With further reference to the drawings, the combination support structure 10 of the present invention is adapted to be supported and transported by a trailer indicated generally by the numeral 54, comprising a bed 56, a pair of spaced apart rails 58, and a forwardly extending tongue 60.

Figure 5:
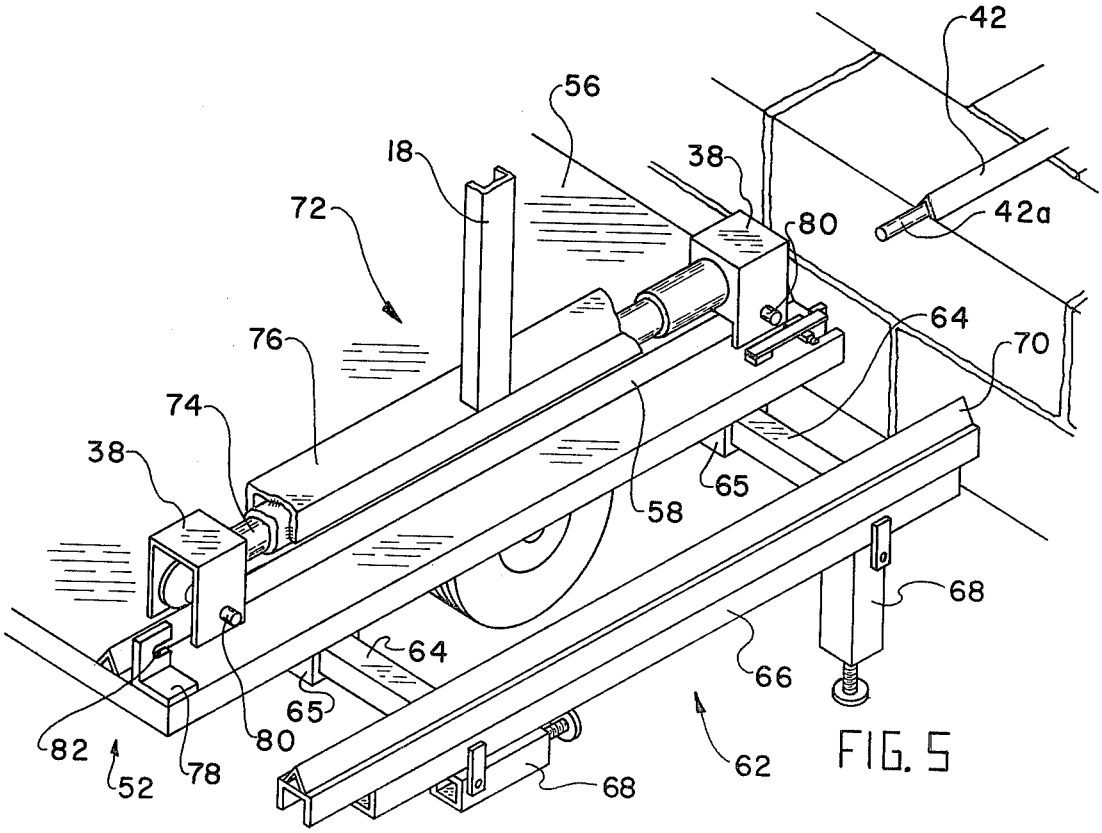
FIG. 5 is a fragmentary perspective view of a universal roller section of the material handling device of the present invention as supported on a trailer.
Figure 8:
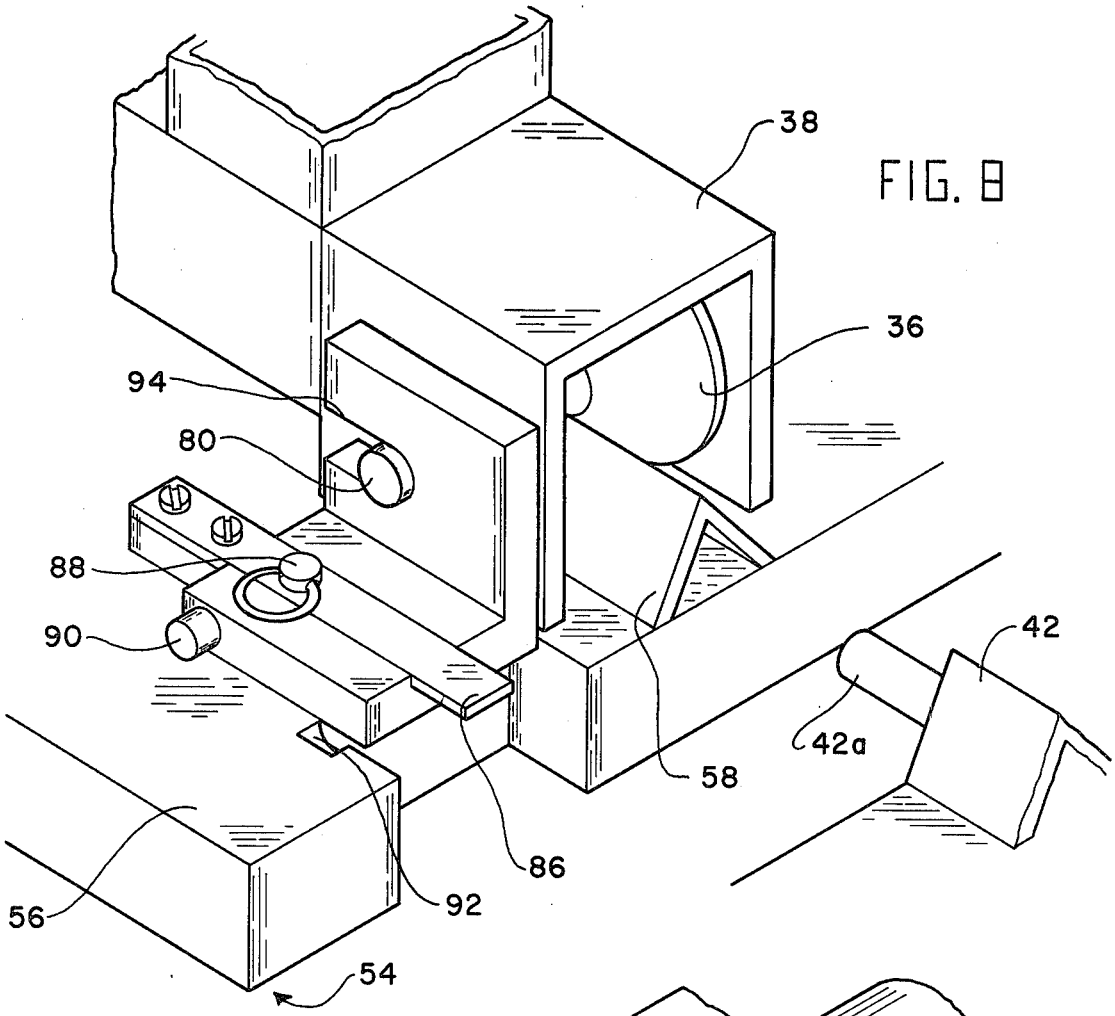
FIG. 8 is a fragmentary perspective view of the trailer that supports the material handling device of the present invention particularly illustrating one of the three movable stop blocks utilized thereon.

Trailer 54 is provided with a side extensible auxiliary front rail extension assembly, indicated generally by the numeral 62 and particularly shown in FIG. 5. Viewing this auxiliary rail extension assembly 62 in detail, it is seen that the same includes a pair of longitudinally spaced transversely extending supports 64 that are supported by support collars 65 secured underneath the trailer bed 56. Extending across said transverse support 64 is a longitudinal rail support 66 that supports a front extension rail 70. When extended outwardly from the trailer 10, the longitudinal rail support 66 is provided with a pair of jack assemblies 68 that are particularly adjustable to support extension rails 70 at a height corresponding to the height of a respective rail 42 within the greenhouse-bulk curing and drying structure that the same is to be aligned with.

Still referring to FIG. 5, the frame structure of the combination support structure 10 of the present invention is provided with a universal roller assembly indicated generally by the numerals 72 in FIG. 5. This universal roller assembly extends between the roller housings 38 formed about the lower right-hand side of the frame structure of the combination support structure 10, as viewed from the front of the trailer and facing the combination support structure disposed thereon. Universal roller assembly 72 includes a main stationary connecting shaft 74 fixed to the respective roller housings 38, the stationary shaft 74 forming a part of the lower rectangular frame 14 referred to above in discussing the main frame structure of the combination support structure 10. Rotatively journaled about stationary shaft 74 is a rotating member assembly 76.

The principal purpose of the universal roller assembly 72 discussed above is to allow the combination support structure 10 of the present invention to be rotated approximately 90 degrees when the same is adapted for the bulk tobacco support mode of operation. In rotating the bulk tobacco container prior to placing the same within the curing and drying structure 40, the same can be rotated approximately 90 degrees about the longitudinal axis of stationary shaft 74, as viewed in FIG. 5. This means that the roller housings 38 (shown in FIG. 5) remain stationary during the rotation, such that when rotated the rollers 38 shown in FIG. 5 are particularly aligned with a rail 42 within the curing and drying structure 40. This design gives rise to a convenient means for rotating the bulk tobacco container 48 and also allows for the two rollers 36 disposed about the right-hand lower side of the combination support structure 10 as viewed from the front of trailer 54 to serve the plant seedlings embodiment shown in FIG. 2 as well as the curing and drying embodiment when rotated as shown in dotted lines in FIG. 3.

Figure 6:
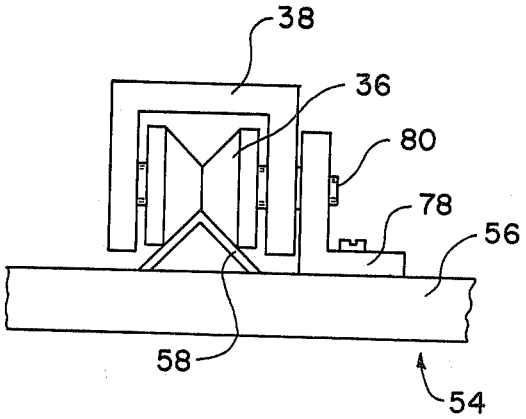
FIG. 6 is a fragmentary front elevational view particularly illustrating a stationary stop block that is utilized on the front right-hand corner of the trailer as viewed from the front end thereof.
Figure 9:
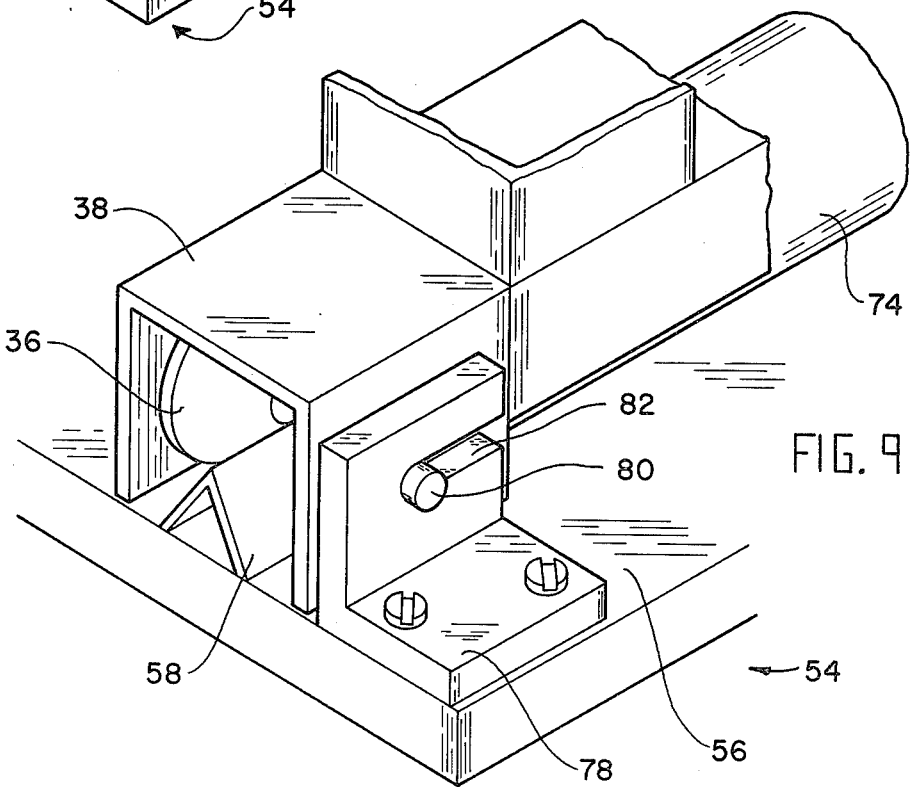
FIG. 9 is a fragmentary perspective view illustrating the stationary stop block shown in FIG. 6.

For stationing the combination bulk support structure 10 about the trailer 54, the right-hand front side of the trailer is provided with a stationary holding and stop block 78 that includes a rearward facing cutout 82 that is adapted to receive a respective stub shaft 80 extending from the right-hand front roller housing 38, as best viewed in FIGS. 6 and 9.

Figure 7:
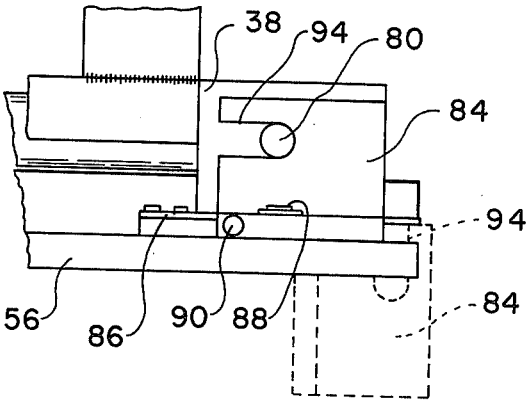
FIG. 7 is a side elevational view of a movable stop block that is utilized on the other three corners of the trailer to maintain the material handling device of the present invention in a stationary position.

Each of the other three corners of the combination support structure 10 is supported by a movable stop 84 that is slidably mounted on trailer bed 56 and engagable with a guide bar 86 that is secured to trailer bed 56. Each movable stop 84 includes a cutout 94 for receiving a respective stub shaft 80 extending from a certain roller housing 38. To free a certain roller housing 38 for proper movement about trailer bed 56, a pin 88 that normally extends through guide bar 86 and through movable stop 84 is removed and respective movable stops 84 can be moved towards a recessed cutout portion about a side of the trailer 54 where the latter is allowed to drop below the plane of the top of the trailer bed 56 as a pair of holding pin shafts 90 associated with the movable stop 84 fall within a part of laterally spaced cups 92 formed within the recessed cutout portions of the trailer. In FIG. 7 a movable stop 84 is shown in a detached-inoperative position in dotted lines.

Briefly reviewing the basic operation of the combination support structure 10 as a bulk tobacco container, it is noted that the same is normally disposed in a tobacco filling position as shown in FIG. 1 where the top imperforated member 50 is swung over adjacent the left side of the container. The container is filled from the bottom up and as a sufficient quantity of tobacco leaves is received therein in random alignment with a plane of the leaves being generally horizontally disposed. Once a sufficient volume of tobacco is received therein one of the respective screens is pivoted from a generally upward position downwardly to a generally horizontal position, compressing the underlying volume of tobacco and wherein the same screen is latched in place by a respective latching mechanism 46 such as a spring steel latch. The filling process is continued with a layer of tobacco generally uniformly distributed above the preceding or underlying screen or divider until another layer of tobacco leaf material is received within the bulk tobacco container 48 at which time another screen is pivoted to the closed position. This is continued until the container is filled which in the preferred embodiment would involve three layers of tobacco, one layer extending between the bottom 52 and the lower screen 24, a second layer between screen 24 and screen 22, and a third layer between screen 22 and imperforated top member 50. Once filled, the entire container 48 is rotated over to the auxiliary extension rail assembly 62, as indicated generally in FIG. 3, to where the layers of bulk tobacco just referred to assume a 90 degree rotated position such that the individual planes of the leaves generally are vertically disposed. Once rotated, the individual bulk containers 48 can be rolled into the greenhouse-curing and drying structure 40 in front-to-back relationship to fill respective bays of the curing and drying structure.

It should be noted that the bulk tobacco container 48 forms a part of the drying chamber of the greenhouse barn and particularly the solar collecting sub-structure within the greenhouse-bulk tobacco curing structure. Imperforated member 50 is generally thermally black about the outside thereof and specifically forms a part of the outside solar collecting sub-structure.

Also, it should be pointed out that in greenhouse use because of multi-layer growth, that the combination support structure 10 or the greenhouse-bulk curing structure 40 may be provided with artificial light.

With reference to FIGS. 10 through 14, a modified support structure 10 is shown therein. This support structure is basically the same as that shown in FIGS. 1 through 9 and described hereinbefore except for the purpose of curing and drying tobacco the support structure 10 in FIGS. 10 through 14 is provided with a series of coil springs adapted to be connected to individual screens 22 and 24 and top 50, in order to bias the screens and top to one side of the structure during the curing and drying operation. This tends to correct and compensate for nonuniform loading of the structure by the farmer, and generally provides a more uniform distribution of the tobacco material within the container during the curing and drying process. This is particularly significant since the density of the tobacco material varies substantially during the curing and drying operation.

Because support structure 10 is basically the same as already described except for the provision of the spring biasing means for the screens and top, the following discussion will principally deal with this difference along with other structural distinctions that exist with respect to the embodiment shown and described in FIGS. 1 through 9. In this regard, the support structure 10 shown in FIGS. 10 and 11 includes a pair of channels 100 formed about the side of the structure in which the screens 22 and 24, and the top 50 are generally hinged, this side being the top side of the structure as viewed in FIGS. 10 and 11. Disposed in each channel 100 is a generally elongated coil spring 102 that is anchored at one point to a point of the frame structure forming a part of the support structure 10, and wherein screens 22 and 24 and top 50 are connected at predetermined points to each of the springs 102. For convenience, the means of attaching the screens and top to each coil spring 102 can be of a detachable design such that when the support structure 10 is stored or in any other desired mode of operation, the screens 22 and 24, and the top 50 can be detached from the respective coil springs 102.

Although various forms of attaching means can be utilized for connecting the respective screens and top to each respective coil spring 102, a suitable design would entail the provision of a collar 122, such as shown in FIGS. 10 and 11, secured to each respective coil spring 102 about a predetermined area, and the provision of a thumb screw or wing nut interconnected between the screens and top and respective collars to form a secure connection therebetween.

Provided about the opposite side of support structure 10, the lower side as viewed in FIGS. 10 and 11, is a second pair of channels 104. Disposed in each of these channels is a like coil spring 106 that is anchored at one end, the end towards which the biasing is directed, to the support structure 10. Associated with each of the coil springs 106 about this side of the structure 10 is a latching block 108, illustrated in FIGS. 12 and 13. The latching blocks 108 include an annular opening **108*a* through which preferably coil springs 106 extends and there is provided a thumb screw or nut 108*b* which extends through the annular opening and the spring 106 extending therethrough to form a secure connection between the latching block 108 and the spring 106. The latching block 108 includes a screen receiving area 108*c* adapted to engage, receive, and hold a respective edge of the screens 22 and 24, and the top 50. As shown in FIG. 12, once a screen or the top is secured within the latch receiving area 108*c* of the latching block 108, that particular screen or top is constrained to move with the latching lock 108 that is biased by spring 106**.

The springs 102 and 106 are preferably selected in order to exert an appropriate and uniform force against tobacco leaf material disposed between the screens in order to hold and support the tobacco leaf material securedly between the screens, but yet not to exert a force great enough to damage or bruise the tobacco.

In FIGS. 10 and 11, the support structure 10 is disposed in the curing and drying position such that air may move through a lower opening 110 formed in the lower part of the structure and upwardly therefrom through the tobacco leaf material disposed between the screens 22 and 24 and/or the top 50.

To assure that air does not leak between the opening 110 and adjacent baffle 112, a folding damper 114 is operatively associated with one edge of the top 50 and is adapted to move therewith so as to bridge any opening that may exist between the baffle 112 and the top 50. It is appreciated that this folding damper could be confined about its outer edges within a track in order to operate efficiently and smoothly.

In addition, the top 50, as shown in FIGS. 10 and 11, is provided with a rubber seal 116 that is adapted to seal the space between the top 50 and the adjacent vertical side 118 and 120 of the structure as shown in FIGS. 10 and 11.

In FIG. 14, a design alternative is shown wherein the coil spring 102 is disposed and anchored exteriorly of the channel 100. In this particular design, the channel 100 would preferably include a track and the respective screens 22 and 24, and the top 50, could be provided with a roller assembly for riding along this track, similar to that shown in FIG. 11. It is appreciated that the spring 102 would still provide a uniform biasing force to the screens and the top to achieve the desired results of the present invention and particularly the objects of the modified design shown in FIGS. 10 through 14.

It is, therefore, appreciated that by biasing the screens and top the problem of nonuniform curing and drying that results from large air spaces being created within the tobacco material during curing and drying would be substantially eliminated. The results should be a more uniform curing and drying with the quality of the final tobacco material after curing and drying being substantially improved.

It is also appreciated that due to the spring forces the tobacco leaves are constantly maintained under higher density than in conventional box curing. This would particularly prevent excessive air circulation within the curing chamber which would waste a considerable amount of electric energy during the later stage of leaf drying and total period of stem drying. This device will prevent the excessive air circulating by maintaining a certain density of drying material to provide air flow resistance, resulting in considerable electric energy saving during curing and drying.

The terms "upper", "lower", "forward", "rearward", etc., have been used herein merely for the convenience of the foregoing specification and in the appended Claims to describe the combination plant seedling-bulk tobacco support structure and its parts as oriented in the drawings. It is to be understood, however, that these terms are in no way limiting to the invention since the combination plant seedling-bulk tobacco support structure may obviously be disposed in many different positions when in actual use.

The present invention, of course, may be carried out in other specific ways than those herein set forth without departing from the spirit and essential characteristics of the invention. The present embodiments are, therefore, to be considered in all respects as illustrative and not restrictive and all changes coming within the meaning and equivalency range of the appended Claims are intended to be embraced herein.

What is claimed is:

1. A combination plant seedling and bulk tobacco support structure adapted to support plant seedlings in one mode of operation and to support a volume of tobacco in another mode of operation, said combination plant seedling and bulk tobacco support structure in said plant seedling support mode of operation comprising: an upstanding frame structure; screen means operatively associated with said frame structure and including a plurality of independent screens normally vertically spaced within said frame structure for supporting plant seedlings at several levels within said frame structure; means associated with said frame structure of said combination support structure for supporting said screens at selected levels within said frame structure such that in the plant seedling support mode, said frame structure is adapted to support multi-layers of plant seedlings; and wherein as used as a bulk tobacco support structure and disposed in a filling position, said screen means of said combination support structure being movable from an open position to a closed position; in said open position said screen means being positioned such that tobacco may be filled below the normal level occupied by a respective screen of said screen means when said respective screen is disposed in said closed position, and wherein in said closed position said screen means is adapted to be positioned over a layer of tobacco filled within said combination support structure and in said closed position said screen means functions to overlay that layer of tobacco underlying said screen means when in the normal filling position; mounting means associated with said screen means for mounting said screen means in said support structure such that respective screens can be moved rectilinear in said support structure when used as a tobacco support structure; and wherein said support structure includes biasing means adapted to be connected to said screen means for biasing individual screens of said screen means in one direction during the curing and drying operation in order to provide a more uniform body of tobacco material, and wherein said screen means extends generally transversely across said combination support structure in said closed position when said combination support structure is disposed in said filling position and wherein said combination support structure is rotated approximately 90 degrees from said filling position to a curing and drying position such that in said curing and drying position said combination support structure includes a plurality of side-by-side columns of tobacco leaves separated by the then vertically disposed and spring biased screen means.

2. The combination support structure of claim 1 wherein when used as a bulk tobacco container and disposed in said filling position, said combination support structure includes means for allowing respective screens of said screen means to pivot about an axis that extends along one side of said frame structure of said combination support structure, and wherein said combination support structure includes screen latching means for securing one side of respective screens opposite the pivoting side to said frame structure such that respective screens of said screen means may be horizontally disposed in said closed position when said bulk tobacco container is disposed in the filling position.

3. The combination support structure of claim 2 wherein in the filling position occupied by the combination support structure when being filled with tobacco, said combination support structure includes a plurality of elongated slots formed about one side of said combination support structure for receiving a side pivot portion of respective screens of said screen means in order that said screens can be generally moved vertically within said slots.

4. The combination support structure of claim 3 wherein said roller means comprises roller sets about three of four longitudinal edges of said combination support structure and wherein said combination support structure is rotatable relative to one roller set such that said one roller set may cooperate with either of the other two roller sets to support said combination support structure about either of two sides.

5. The combination support structure of claim 1 wherein when used as a bulk tobacco container and disposed in the rotated curing and drying position, said combination support structure includes a pair of laterally spaced longitudinally extending imperforated side members.

6. The combination support structure of claim 5 wherein said imperforated side members are detachably mounted from said combination support structure during use of the latter in the plant seedling support mode of operation.

7. The combination support structure of claim 5 wherein when used as a bulk tobacco container and disposed in the curing and drying position, said combination support structure includes top, bottom, and end portions comprised of perforated side means for generally containing the tobacco within said combination support structure, wherein said perforated and imperforated sides form a generally rectangular shaped bulk tobacco container structure.

8. The combination support structure of claim 1 wherein roller means are provided about two sides of said combination support structure for allowing the latter to be moved along either side having said roller means thereon.

9. The combination support structure of claim 1 wherein when used for plant seedling support, said screens are adapted to receive open bottom multiple cell growing and handling trays such that the bottom of each tray is exposed to air and consequently an air pruning effect is realized and such prevents plant roots from tangling for better growth.

* * * * *